US008656600B2

(12) United States Patent
Hammer

(10) Patent No.: US 8,656,600 B2
(45) Date of Patent: Feb. 25, 2014

(54) PENCIL SHARPENER CONFIGURED TO WORK WITH A POWER DRILL

(76) Inventor: Walter F Hammer, Newton, PA (US)

( * ) Notice: Subject to any disclaimer, the term of this patent is extended or adjusted under 35 U.S.C. 154(b) by 210 days.

(21) Appl. No.: 13/100,114

(22) Filed: May 3, 2011

(65) Prior Publication Data

US 2011/0265911 A1 Nov. 3, 2011

Related U.S. Application Data

(63) Continuation-in-part of application No. 13/094,804, filed on Apr. 26, 2011.

(60) Provisional application No. 61/343,739, filed on May 3, 2010.

(51) Int. Cl.
*B43L 23/00* (2006.01)

(52) U.S. Cl.
USPC ..... 30/451; 30/500

(58) Field of Classification Search
USPC ..... 408/226; 144/28.1–28.9; 30/451–462, 30/500
See application file for complete search history.

(56) References Cited

U.S. PATENT DOCUMENTS

| | | | | | |
|---|---|---|---|---|---|
| D21,864 | S | * | 9/1892 | Davis | D19/73 |
| D22,853 | S | * | 10/1893 | Foster | D19/73 |
| 585,670 | A | * | 7/1897 | Graves | D19/73 |
| 653,720 | A | * | 7/1900 | Weitzel | 30/454 |
| D34,335 | S | * | 4/1901 | Stassart | D19/73 |
| 889,135 | A | * | 5/1908 | Jones | 30/454 |
| 1,281,747 | A | | 10/1918 | Allen | |
| 1,887,422 | A | * | 11/1932 | Oulton | D19/73 |
| 2,366,928 | A | * | 1/1945 | Paschell | D19/73 |
| D149,356 | S | * | 4/1948 | Jalof | D19/73 |
| 2,470,387 | A | * | 5/1949 | Baggett | 144/28.4 |
| 2,525,854 | A | * | 10/1950 | Becker | 30/454 |
| 2,540,528 | A | * | 2/1951 | Itano | 30/454 |
| 2,545,779 | A | * | 3/1951 | Harrison | D19/73 |
| 2,558,902 | A | * | 7/1951 | Itano | 30/454 |
| 2,691,960 | A | * | 10/1954 | Leeds et al. | 30/454 |
| 2,708,905 | A | * | 5/1955 | Randall | D19/73 |
| 2,857,884 | A | * | 10/1958 | Itano | 30/454 |
| 3,049,096 | A | * | 8/1962 | Hampton | 144/28.11 |
| D201,734 | S | * | 7/1965 | Derenski | D19/73 |
| 3,776,286 | A | * | 12/1973 | Blanck | 144/28.5 |
| 3,827,469 | A | * | 8/1974 | Mobius | 30/453 |
| 3,980,114 | A | * | 9/1976 | Maniscalki | 30/457 |
| D241,743 | S | * | 10/1976 | Lemieux | D19/73 |
| 4,248,283 | A | * | 2/1981 | Kaye | 30/454 |
| 4,485,862 | A | * | 12/1984 | Mattheis et al. | 30/454 |
| 4,991,299 | A | * | 2/1991 | Dietterich et al. | 30/453 |
| 5,647,138 | A | * | 7/1997 | Tang et al. | 30/454 |
| D402,691 | S | * | 12/1998 | Zbras, Jr. | D19/73 |
| 6,092,293 | A | | 7/2000 | Donaldson | |
| 6,237,656 | B1 | | 5/2001 | Whitehead et al. | |
| 6,279,237 | B1 | * | 8/2001 | Luttgens | 30/454 |
| 6,290,437 | B1 | * | 9/2001 | Mattheck et al. | 408/11 |
| 6,301,791 | B1 | * | 10/2001 | Luttgens | 30/454 |
| D461,206 | S | * | 8/2002 | Gstalder | D19/73 |

(Continued)

*Primary Examiner* — Jason Daniel Prone

(57) ABSTRACT

An example adapter for converting a manual-pencil sharpener into a powered sharpener for carpenter pencils is described. The example adapter has a housing including two cavities. A first cavity is configured to receive a substantial portion of a manual-pencil sharpener for carpenter pencils therein. A second cavity extends in a lengthwise and axial position opposite the first cavity. The second cavity has a complementary shape and size configured to receive a substantial portion of a hex-bit therein.

5 Claims, 6 Drawing Sheets

(56) References Cited

U.S. PATENT DOCUMENTS

| | | | | |
|---|---|---|---|---|
| 6,473,976 | B1 * | 11/2002 | Cocchiarella | 30/500 |
| 6,494,638 | B1 | 12/2002 | Donaldson | |
| 6,571,480 | B1 | 6/2003 | Qiu | |
| 6,746,186 | B2 * | 6/2004 | Ukai | 408/226 |
| D494,222 | S * | 8/2004 | Berry | D19/73 |
| 7,225,547 | B2 * | 6/2007 | Luttgens | 30/457 |
| D580,462 | S * | 11/2008 | Liao et al. | D15/139 |
| 7,523,557 | B2 | 4/2009 | Smith et al. | |
| 7,530,771 | B2 * | 5/2009 | Kozak | 408/226 |
| 2011/0097170 | A1 * | 4/2011 | Miller | 408/226 |
| 2011/0265911 | A1 * | 11/2011 | Hammer | 144/28.3 |
| 2013/0174429 | A1 * | 7/2013 | Constantine et al. | 30/454 |

* cited by examiner

PENCIL SHARPENER CONFIGURED TO WORK WITH A POWER DRILL

CROSS REFERENCE TO RELATED APPLICATIONS

This is application is a continuation-in-part of U.S. application Ser. No. 13/094,804, filed Apr. 26, 2011 to Walter Hammer entitled "Pencil Sharpener", which is incorporated herein by reference. This application also claims priority to application No. 61/343,739 filed May 3, 2010, entitled "Hand and Drill Driven Carpenters Pencils Sharpener," which is incorporated herein by reference.

TECHNICAL FIELD

This patent application is related to devices for sharpening pencils.

BACKGROUND

A carpenter pencil is usually rectangular in shape, which is intended to stabilize the pencil when placed on a flat or angled surface to prevent it from rolling.

Unfortunately, because of its shape a carpenter pencil is not compatible with a conventional-cylindrical-pencil sharper for sharpening cylindrically shaped, wooden pencils. Specifically, a carpenter pencil is too large for the opening of a pencil sharpener for cylindrically shaped pencils.

There is generally only one category of dedicated-sharpener devices available for sharpening carpenter pencils: manual. These sharpeners are usually inexpensive and portable, but are very slow. For instance, it can take well over one minute to sharpen a carpenter pencil using a manual sharpener on the market today, among other drawbacks.

SUMMARY

An adapter for converting a manual-pencil sharpener into a powered sharpener. The adapter has a housing including two cavities. A first cavity is configured to receive a substantial portion of a manual-pencil sharpener for carpenter pencils therein. A second cavity extends in a lengthwise and axial position opposite the first cavity. The second cavity has a complementary shape and size configured to receive a substantial portion of a hex-bit therein.

In other embodiments, a new design for a dedicated carpenter-pencil sharpener is described including method of making the same.

Further details and advantages will become apparent with reference to the accompanying drawings and the following detailed description.

BRIEF DESCRIPTION OF THE DRAWINGS

The detailed description is presented with reference to the accompanying figures. In the figures, the left-most digit(s) of a reference number identifies the figure in which the reference number first appears. It is emphasized that the various features in the figures are not drawn to scale, and dimensions of the various features may be arbitrarily increased or reduced for clarity of discussion.

DETAILED DESCRIPTION

Figure 1:
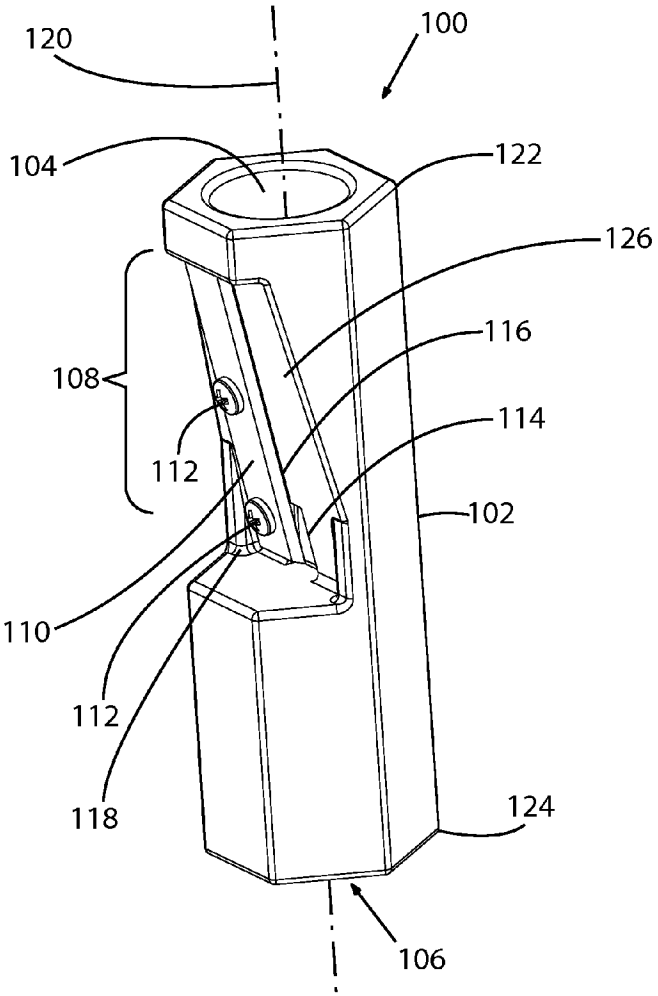
FIG. 1 is a perspective view of a sharpener for sharpening carpenter pencils.

FIG. 1 is a perspective view of a sharpener 100 for sharpening carpenter pencils. The illustrated embodiment of sharpener 100 includes: a housing 102, a pencil-tip-insertion hole 104, a hex-bit-drive hole 106 (not visible in FIG. 1), a blade-retention slot 108, a blade 110, mountings 112, a point well 114, a shaving discharge slot 116, and a blade-reinforcement edge 118.

Example Housing

Housing 102 may be constructed of any suitable material that can withstand the rigors of being used in a construction environment. For instance, housing 102 may be constructed of resilient plastic, aluminum, fiberglass, steel, wood, or any combination thereof.

In one embodiment, housing 102 is pocket sized, being generally hexagonal in shape, and is approximately 3.0 inches in length, and about 0.85 inches thick. The hexagonal shape makes gripping sharpener 100 easy, and prevents it from rolling when set down on a flat or angled surface. Chamford edges (also referred to as beveled edges) may also be included as part of body 102.

As appreciated by those skilled in the art, after having the benefit of this disclosure, housing 102 may be of other sizes, and shapes such as spherical, rectangular, or other configurations.

Housing 102 provides a framework for a person to grasp sharpener 100, and to withstand torquing forces imparted on housing 102 when housing 102 is rotated by a drill or electric driven bit as will be explained.

A center axis 120 runs lengthwise from a proximal end 122 to a distal end 124 of housing 102.

Example Pencil-Tip-Insertion Hole

Figure 2:
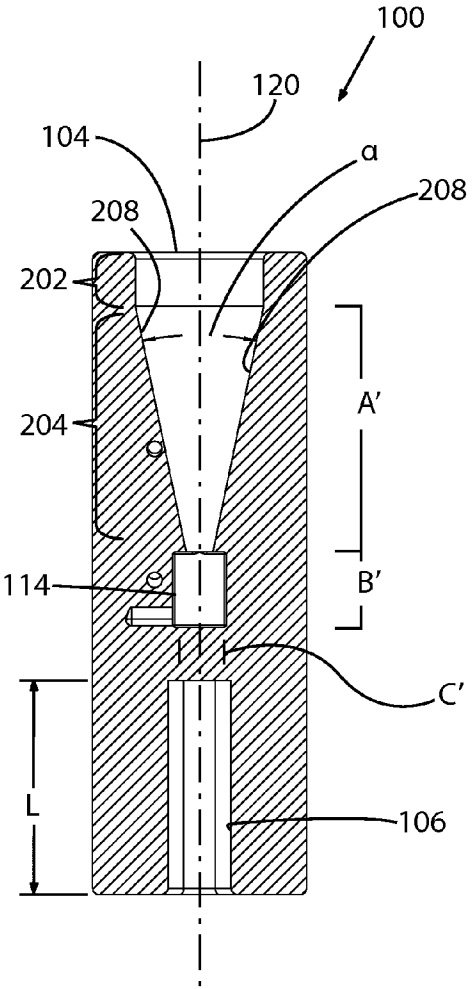
FIG. 2 shows a side-cross-sectional view of an example sharpener.

Located at proximal end 122 of housing 102 is pencil-tip-insertion hole 104. FIG. 2 shows a side-cross-sectional view of sharpener 100. In one embodiment, pencil-tip-insertion hole 104 includes an insertion portion 202 (FIG. 2) which is cylindrical in shape, and large enough to receive at least a portion of a shaft of an unsharpened carpenter pencil.

For instance, in one embodiment, insertion portion 202 of pencil-tip-insertion hole is approximately 0.25 inches when measured in lengthwise-axial direction from proximal end 122. As appreciated by those skilled in the art, after having the benefit of this disclosure, insertion portion 202 may be of other sizes, and shapes such as rectangular, or corresponding to the general outer-boundary shape of a carpenter pencil.

Still referring to the example of FIG. 2, pencil-tip insertion hole 104 also includes a conical portion 204, which tapers inwardly toward center axis 120, as pencil-tip insertion hole 104 approaches an approximate center of housing 102 measured about midway between proximal end 122 and distal end 124.

In one embodiment, an angle $\alpha$ for the tapering of inner sides 208 of conical portion 204 is approximately 23 degrees. Additionally, conical portion 204 has a length A' of approximately 1.25 inches. As appreciated by those skilled in the art with the benefit of this disclosure, however, larger or smaller angles for a (such as ranging between 18 and 40 degrees) or sizes for length A' of conical portion 204 may be implemented depending on the shape and sharpness desired for the tip of a pencil.

Referring to FIGS. 1 and 2, point well 114 is at a distal end 124 of conical portion 204 of pencil-tip insertion hole 104. As shown in FIG. 1, point well 114 provides an opening for a lead/graphite point to reside when a pencil is sharpened. Referring to FIG. 2, well point 114 has a length B' and a width C'. In one embodiment, B' is approximately 0.10 inches C' is approximately 0.20 inches; although other suitable dimensions may be implemented for B' and C', as would be appreciated by those skilled in the art having the benefit of this disclosure.

Although pencil-tip-insertion hole 104 is generally described here and shown in the examples may take different configurations. For example, insertion portion 202 may not be needed, and inner sides 208 width of conical portion 204 may be asymmetrical. Other suitable configuration may be implemented for pencil-tip-insertion hole 104, as appreciated by those skilled in the art, after having the benefit of this disclosure.

In one embodiment, pencil-tip-insertion hole 104—including its example constituent parts such as insertion portion 202, conical portion 204, and well point 114—is aligned axially about central axis 120. Nevertheless, it is possible for "alignment" between pencil-tip-insertion hole 104 and central axis 120, to be slightly off as result of intentional misalignment, or a tolerance variation, as should be appreciated by those skilled in the art, after having the benefit of this disclosure.

In one embodiment, pencil-tip-insertion hole 104, including its example constituent parts, are fixed in relation to housing 102, and do not rotate or move independently of housing 102. That is, in one example, housing 102 and pencil-tip-insertion hole 104—including its example constituent parts such as insertion portion 202, conical portion 204, and well point 114—move in unison and do not move independently of from each other.

Example Blade-Retention Slot

Referring to FIG. 1, blade-retention slot 108 is an angled-cutout portion of housing 102. Specifically, in one embodiment, blade-retention slot 108 corresponds in length, size, and angle of an outer side 126 of conical portion 204 (FIG. 2). The length of blade-retention slot 108 also includes the additive length well point 114.

Figure 3:
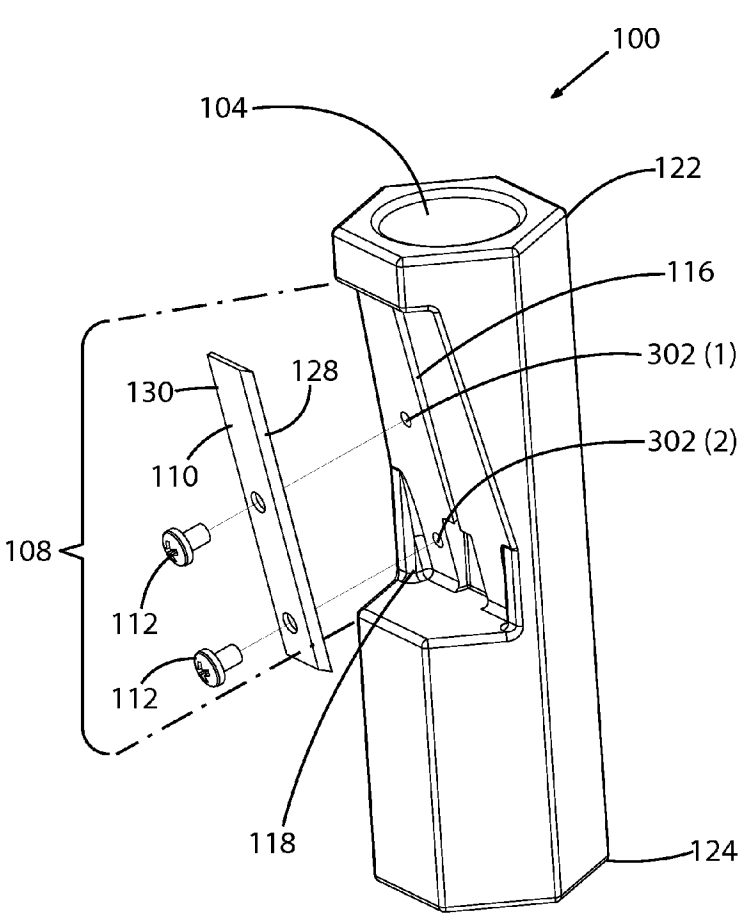
FIG. 3 shows an exploded-perspective view of an example sharpener.

FIG. 3 shows an exploded-perspective view of sharpener 100. With respect to FIG. 3, blade-retention slot 108 includes blade 110, mounting holes 302(1), 302(2), a shaving discharge slot 116, and a blade-reinforcement edge 118.

Shaving-discharge slot 116 is a gap that in one embodiment runs a length of conical portion 204 (FIG. 2), although the size of the gap may be larger or smaller in different implementations. Beside allowing shavings from a pencil to be expelled from the inside of pencil-tip-insertion hole 104, shaving-discharge slot 116 also serves as a gap for a cutting edge 128 of blade 110 to contact a pencil in pencil-tip-insertion hole 104 when inserted therein.

Mountings 112, such as screws, pins, bolts, solder or other fastening means may be used to fasten blade 110 to housing 102. Alternatively, blade 110 may be fastened to housing 102 without mountings or mounting holes, such as via glue, solder, or other fastening means as would be readily appreciated by those skilled in the art after having the benefit of this disclosure.

Located on a side of blade 110 opposite cutting edge 128, is a non-cutting edge 130 of blade 110. A portion or all of non-cutting edge 130 may be buttressed against a blade-reinforcement edge 118, which prevents blade 110 from moving and shifting when cutting edge 128 engages a pencil. In the example of FIGS. 1 and 3, only a portion of non-cutting edge 130 is buttressed by blade-reinforcement edge 118.

Figure 4:
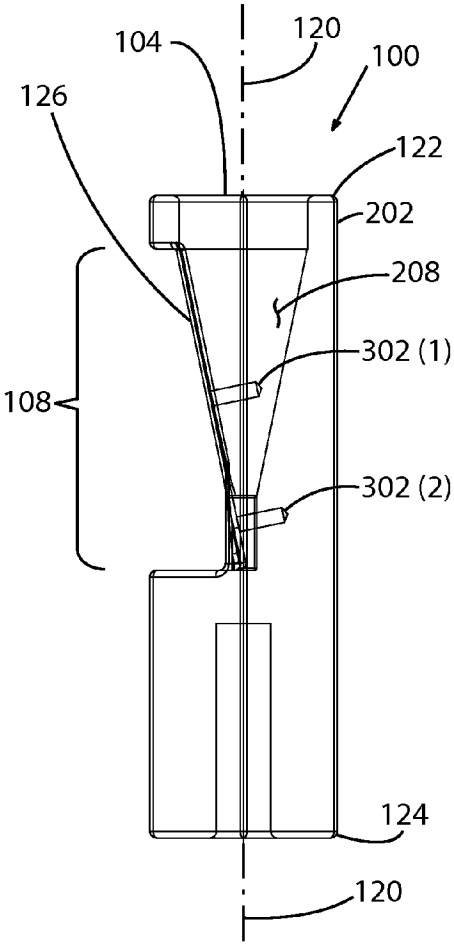
FIG. 4 shows a cross-sectional-side view of an example sharpener.

FIG. 4 shows a cross-sectional-side view of sharpener 100, rotated 90 degrees from the view point of FIG. 2.

Example Hex-bit-Drive Hole

Referring back to FIG. 2, a hex-bit-drive hole 106 extends at least partially through housing 102, and opposite pencil-tip-insertion hole 104. In one embodiment, hex-bit-drive hole 106 is in axial alignment with pencil-tip-insertion tool 104 and the central axis 120. Nevertheless, it is possible for "alignment" between hex-bit-drive hole 106 and central axis 120, to be slightly off as result of intentional misalignment, or a tolerance variation, as should be appreciated by those skilled in the art, after having the benefit of this disclosure.

Figure 6:
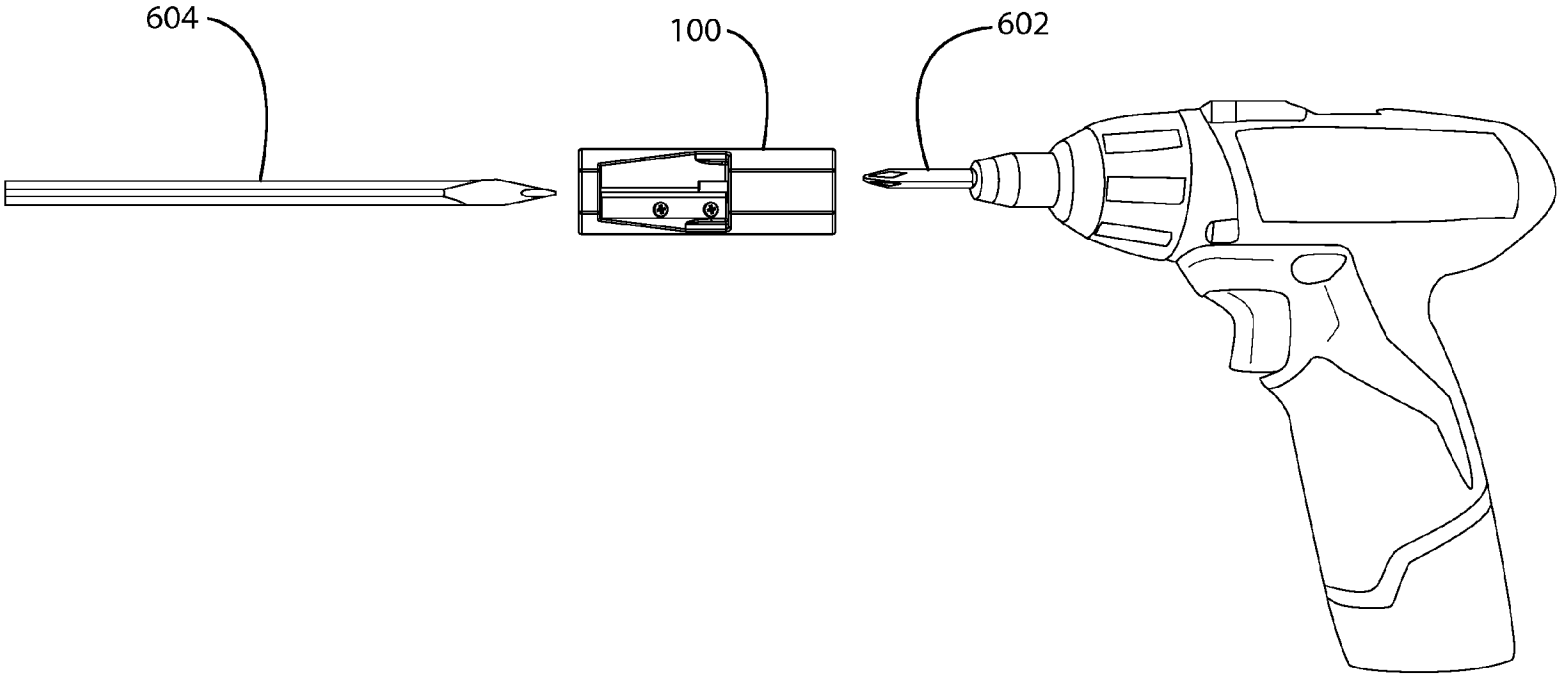
FIG. 6 shows a side perspective view of a carpenter pencil and hex bit before engagement inside an example sharpener.

In one embodiment, hex-bit-drive hole 106 has a shape and size configured to (i) receive portion of a hex bit, and (ii) engage the hex bit 602 (shown in FIG. 6) when the hex bit rotates clockwise or counter-clockwise when the hex bit (not shown) is inserted inside hex-bit-drive hole 106 and rotates clockwise or counterclockwise via drill or a powered screwdriver (see also FIG. 6).

Figure 5:
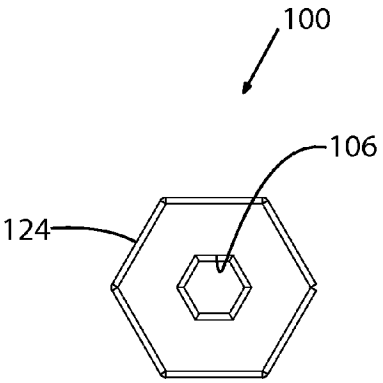
FIG. 5 shows top view of a distal end of an example sharpener.

For example, FIG. 5 shows top view of distal end 124 of sharpener 100. As shown in this example, hex-bit-drive hole 106 has a shape of slightly larger than a standard hexagonal-hex bit, such as used with a standard sized Phillips screw driver. That is, hex-bit-drive hole 106 is configured to fit coextensively around the bit of a hex bit (referred to as 602 in FIG. 6). In one embodiment, hex-bit-drive hole 106 is a fixed chamber inside housing 102, with the shape of hole 106 corresponding to the outer shape of housing 102.

As used herein a "hex bit" means any drive mechanism that attaches to a powered drill or screwdriver, and may be different shapes, sizes, and configurations. For instance, although referred to as a hex (short for hexagonal), hex bit may be square or other shapes.

It is also appreciated that hex-bit-drive hole 106 may include an adapter (not shown) configured to engage different shaped, sized, and configured hex bits. For example, hex-bit-drive hole 106 may include movable members that can be adjusted to fit the size of different hex bits such as a built-in chuck (not shown).

Referring back to FIG. 2, in one embodiment hex-bit-drive hole 106 has a length L, which is approximately 1.0 inches. Nevertheless, as appreciated by those skilled in the art, after having the benefit of this disclosure, hex-bit-drive hole 106 may be of other lengths L, sizes, and shapes, or other configurations.

In one embodiment, hex-bit-drive hole 106 is fixed in relation to housing 102 and pencil-tip-insertion hole 104, and does not rotate or move independently of either. That is, in one example, housing 102, pencil-tip-insertion hole 104, and hex-bit-drive hole 106 move in unison and do not move independently with respect to each other. So, when the hex bit (not shown) rotates clockwise or counter-clockwise it causes housing 102, pencil-tip-insertion hole 104, and hex-bit-drive hole 106 to spin together. Provided a user of sharpener 100 firmly grips the pencil in one hand (i.e., opposite the end inserted into pencil-tip-insertion hole 104), and the user grasps a powered device in his other hand, only sharpener 100 (and all or most of its constituent parts) will spin thereby sharpening a carpenter pencil.

FIG. 6 shows a side perspective view of a carpenter pencil 604 and hex bit 602 before being inserted inside an example sharpener 100.

Figure 7:
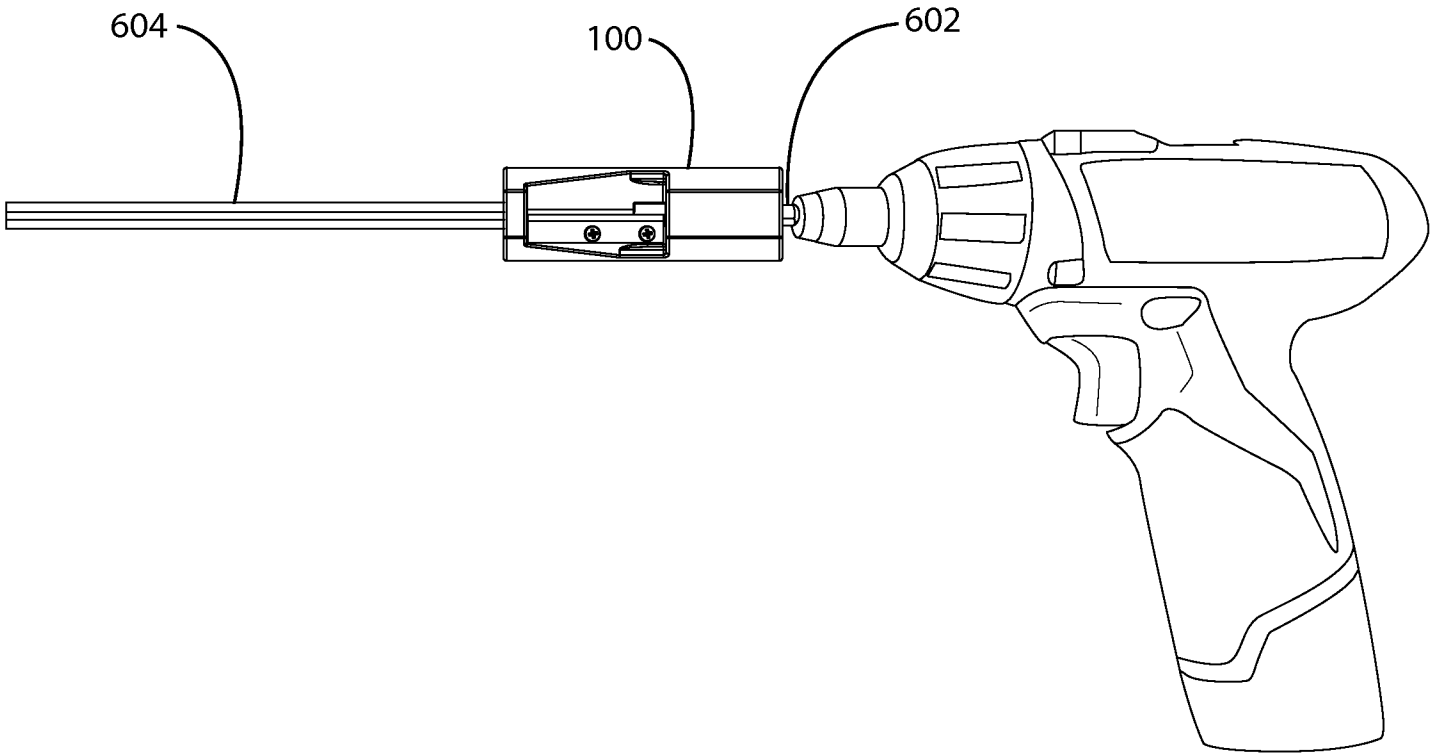
FIG. 7 shows a side-perspective view of a carpenter pencil and hex bit engaged inside an example sharpener.

FIG. 7 shows a side perspective view of a carpenter pencil 604 and hex bit 602 after both are inserted inside an example sharpener 100. Again, the user may grasp pencil 604 in one hand, and the drill (or other power source) in the other.

Example Adapter

Figure 8:
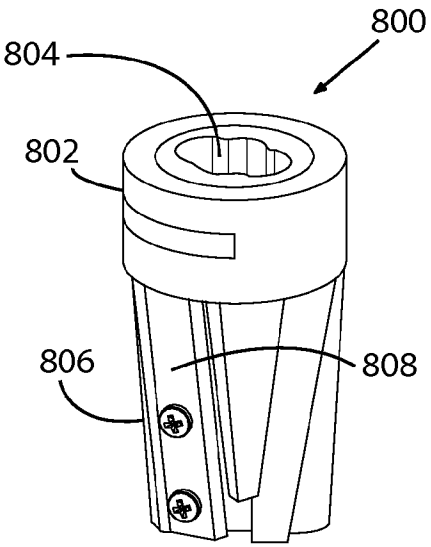
(Prior Art) FIG. 8
FIG. 8 shows a perspective view of an example of manual commercial-pencil sharpener for a carpenter pencil.

FIG. 8 shows a perspective view of an example of manual commercial-pencil sharpener 800 for a carpenter pencil, which is prior art. Sharpener 800 includes a movable collar 802 with an opening 804 for receiving a carpenter pencil. Sharpener 800 also includes a rectangular-shaped body 806 with rounded edges, in which a blade 808 is mounted. When collar 802 is rotated relative to body 806, a pencil is sharpened by blade 808.

In the illustrated example, sharpener 800 is a "Flat Pencil Sharpener" by C.H. Hanson Inc. of Franklin Park, Ill., USA. It is appreciated by those skilled in the art after having the benefit of this disclosure that other conventional-carpenter-pencil sharpeners of different shapes and sizes are suitable for use with an illustrated example adapter to be described herein. For instance, an embodiment of an adapter described herein may be configured for use with other manufacturers of carpenter pencils, such as, but not limited to, Johnson Level & Tool Mfg. Co, of Mequon, Wis., USA.

Figure 9:
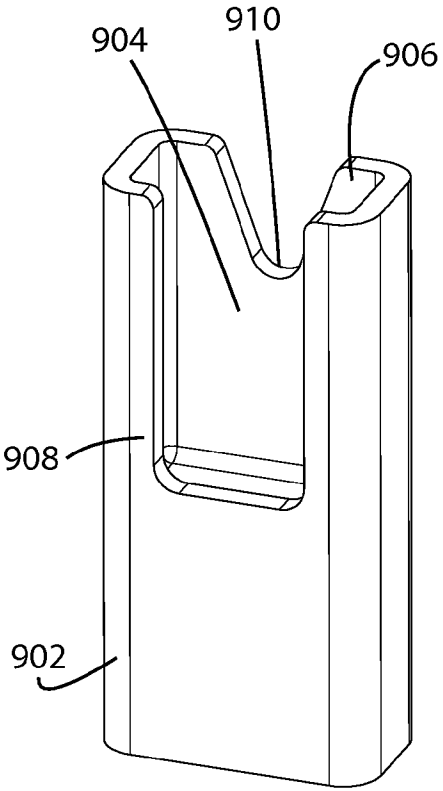
FIG. 9 shows a perspective view of an example adapter for use with a conventional manual sharper such as illustrated in FIG. 8.

FIG. 9 shows a perspective view of a new example adapter 900 for use with a conventional manual sharper such as illustrated in FIG. 8.

Adapter 900 includes a body 902 (i.e., a housing), which may be constructed of any suitable material which can withstand the rigors of being used in a construction environment. For instance, body 902 may be constructed of resilient plastic, aluminum, fiberglass, steel, wood, or any combination thereof.

In one embodiment, body 902 may be a partially hollow and configured of a complementary shape so as to be able to receive a sharpener 800 inserted therein. For instance, body 902 includes a cavity 904 having internal surfaces 906 of a shape and size complementary with external portions of sharpener 800, and specifically, those portions of sharpener 800 underneath collar 802 (i.e. body 806 of sharpener 800). For example, the dimensions of internal surfaces 906 may be configured to envelope and fit co-extensively with external boundary surfaces of sharpener 800.

Body 902 may also include two asymmetrical slots 908 and 910. Slot 908 is configured to leave the area surrounding blade 808 clear from obstruction, such as from shavings to empty from sharper 800 when sharpener 800 is rotated. Slot 910 is configured to allow collar 802 and the conical shape of the external sides of sharper 800 to seat itself within cavity 904. As appreciated by those skilled in the art, slots 908 and 910 do not necessarily have to be asymmetrical, and may instead be symmetrical. Additionally, in embodiment, it is possible to have only one slot such as slot 908, or in another embodiment no slots at all.

Figure 10:
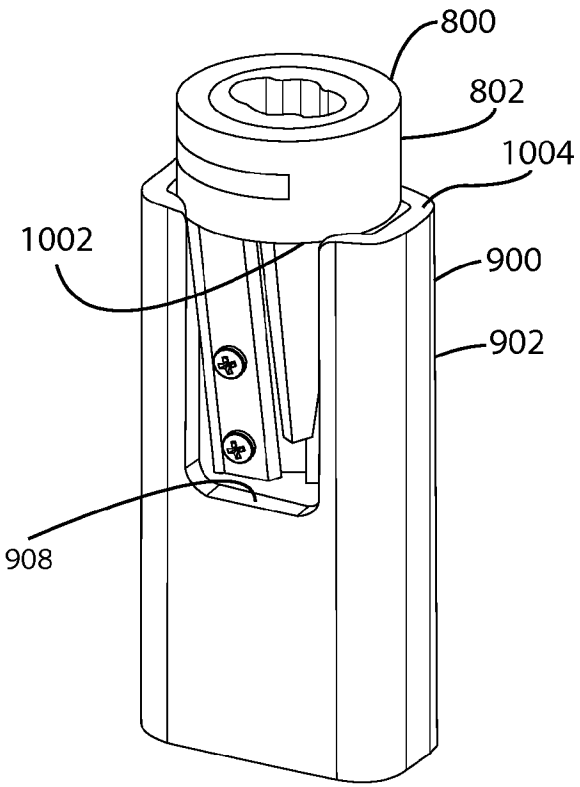
FIG. 10 shows a sharpener fully seated in a body of an example adapter.

FIG. 10 shows a sharpener 800 fully seated in body 902 of an example adapter 900. In this example, a bottom edge 1002 of collar 802 engages a top edge 1004 of body 902, which prevents sharpener 800 from being inserted beyond the interface between the two opposing edges 1002/1004.

Figure 11:
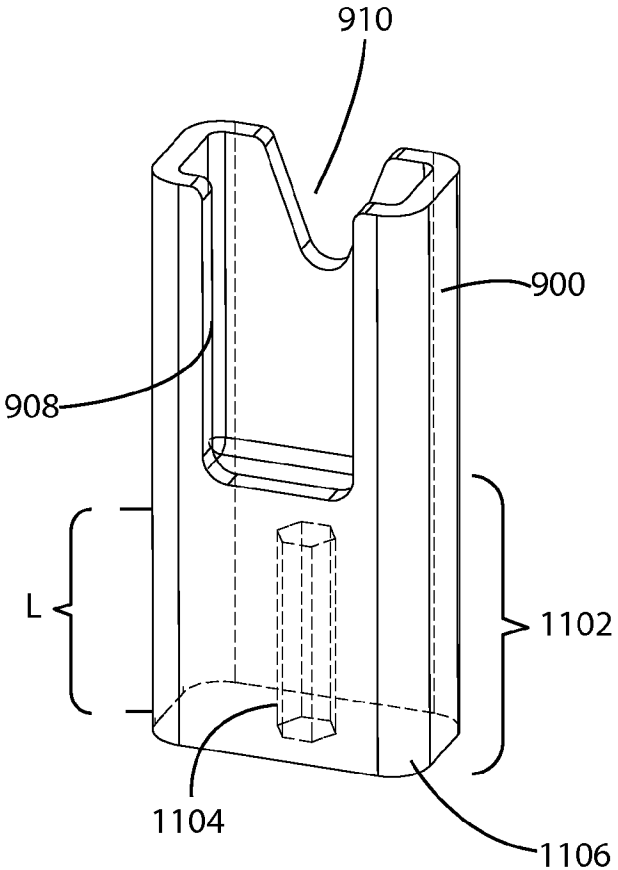
FIG. 11 shows a cross sectional view of an example adapter.

FIG. 11 shows a cross sectional view of an example adapter 900. As shown in FIG. 11, adapter 900 also includes a hex-bit portion 1102, which includes a hex-bit-drive hole 1104 extending at least partially through body 902 opposite top edge 1004. Hex-bit-drive hole 1104 is generally of a width and complementary shape to fit coextensively around at a least a portion of a hex bit from a power drill or other powered device such as powered-screw driver.

In one embodiment, hex-bit-drive hole 1104 has a length L, which is approximately 1.0 inches. Nevertheless, as appreciated by those skilled in the art, after having the benefit of this disclosure, hex-bit-drive hole 1104 may be of other lengths L, and be of other sizes, and shapes, or other configurations, such as described above with respect to sharper 100 (FIG. 1).

In the example of FIG. 11, adapter 900 may include a generally solid section 1106 hex-bit extending beyond cavity 904. Solid section 1106 is generally of the same width as adapter 900 measured coaxially with respect to a lengthwise axial direction of a pencil, when inserted into sharper 800. As appreciated by those skilled in the art, solid section 1106 may be less than completely solid or may include a framework intended to provide an engagement with a hex bit when the hex bit is inserted into hex-bit-drive hole 1104.

Figure 12:
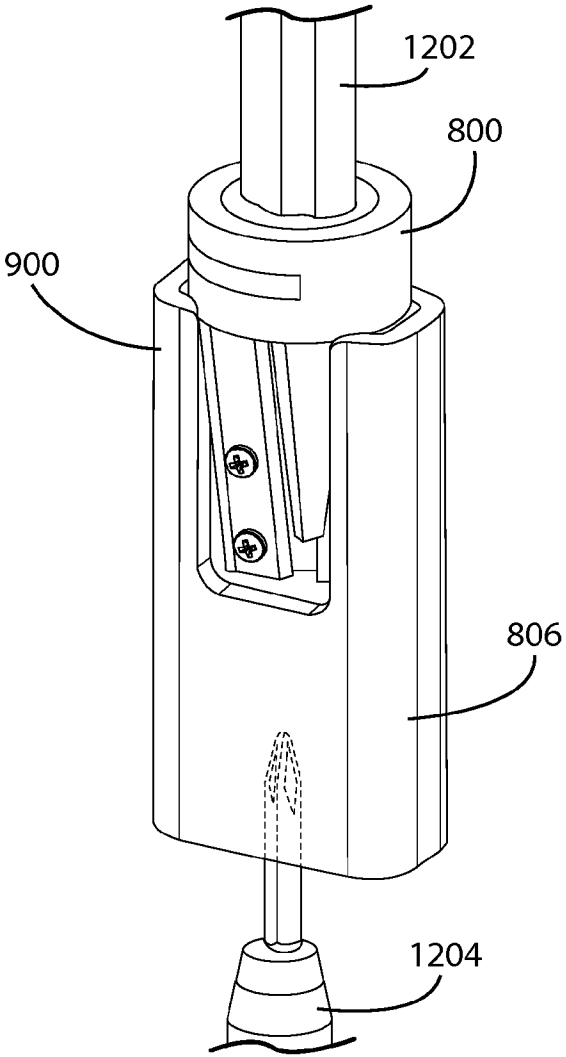
FIG. 12 shows a side perspective view of an example carpenter pencil and hex bit (mostly obstructed in this view) after the pencil is inserted inside a sharpener, and the hex bit is inserted inside a hex-bit-drive hole.

FIG. 12 shows a side perspective view of a carpenter pencil 1202 and hex bit (not shown in this view) after pencil 1202 is inserted inside a sharpener 800, and the hex bit is inserted inside hex-bit-drive hole 1104. Here, a user may grasp pencil 1202 in one hand, and the drill 1204 (or other power source) in the other. So, when the hex bit (not shown) rotates clockwise or counter-clockwise it causes body 806 of sharpener 800 and adapter 900 to spin or rotate while collar 802 remains generally stationary. Thus, adapter 900 may be used to convert a conventional-manual sharpener 800 into a powered sharpener.

Conclusion

Reference herein to "one embodiment", "an embodiment", an "example" or similar formulations, means that a particular feature, structure, operation, or characteristic described in connection with the embodiment, is included in at least one embodiment. Thus, the appearances of such phrases or formulations herein are not necessarily all referring to the same embodiment. Furthermore, various particular features, structures, operations, or characteristics may be combined in any suitable manner in one or more embodiments.

It is to be understood that the subject of this application is not limited to the embodiments described above, but encompasses any and all embodiments within the scope of the subjoined Claims and their equivalents.

What is claimed is:

1. A pencil sharpener for use with a drill comprising: a sharpener member having a rectangular member, a portion with a pencil receiving hole, and a blade mounted directly to the rectangular member; a housing member having four sidewalls, a base wall with a drill bit receiving hole, an open end opposite the base wall, and a rectangular hollow portion defined by inner portions of the four sidewalls, wherein the hollow portion is in communication with the open end; the rectangular member of the sharpener member is received in the rectangular hollow portion via the open end such that the rectangular member engages the inner portions of the four sidewalls so that the sharpener member is in a fixed relation relative to the housing member; an opening in one of the four sidewalls, the opening is in communication with the open end and the rectangular hollow portion so that when the rectangular member is received in the rectangular hollow portion the blade is exposed via the opening; and the drill bit receiving hole of the base wall is configured to receive a drill bit of the drill, wherein rotation of the drill bit via the drill rotates the housing member which in turn rotates the blade.

2. The pencil sharpener of claim 1 wherein the portion with the pencil receiving hole rotates relative to the blade.

3. The pencil sharpener of claim 1 wherein the drill bit receiving hole is in a shape of a hexagon.

4. The pencil sharpener of claim 1 further comprising a second opening in another one of the four sidewalls, the second opening is in communication with the open end and the rectangular hollow portion.

5. The pencil sharpener of claim 1 further comprises a longitudinal axis and the pencil receiving hole has a shape that is elongated in a direction perpendicular to the longitudinal axis.

* * * * *